US005482576A

United States Patent [19]

Heller et al.

[11] Patent Number: 5,482,576

[45] Date of Patent: Jan. 9, 1996

[54] RAILWAY-TRACK ELEMENTS AND METHOD OF MANUFACTURING THEM

[75] Inventors: Wilhelm Heller, Duisburg; Gerhard Ratz, Langgöns, both of Germany

[73] Assignee: BWG Butzbacher Weichenbau, GmbH, Butzbach, Germany

[21] Appl. No.: 256,148

[22] Filed: Jan. 10, 1993

[86] PCT No.: PCT/EP93/00035

§ 371 Date: Jul. 8, 1994

§ 102(e) Date: Jul. 8, 1994

[87] PCT Pub. No.: WO93/14230

PCT Pub. Date: Jul. 22, 1993

[30] Foreign Application Priority Data

Jan. 11, 1992 [DE] Germany ..... 42 00 545.0

[51] Int. Cl.[6] ..... C22C 38/24; C21D 9/04

[52] U.S. Cl. ..... 148/334; 148/902; 148/581; 148/584

[58] Field of Search ..... 148/581, 584, 148/334, 902

[56] References Cited

U.S. PATENT DOCUMENTS

| | | | |
|---|---|---|---|
| 4,575,397 | 3/1986 | Heller | 148/584 |
| 4,767,475 | 8/1988 | Fukuda et al. | 148/902 |

FOREIGN PATENT DOCUMENTS

| | | | |
|---|---|---|---|
| 247021 | 11/1987 | European Pat. Off. . | |
| 2541978 | 3/1977 | Germany . | |
| 3111420 | 10/1982 | Germany . | |
| 3446794 | 1/1986 | Germany . | |
| 55-125231 | 9/1980 | Japan | 148/584 |

*Primary Examiner*—Deborah Yee

*Attorney, Agent, or Firm*—Dennison, Meserole, Pollack & Scheiner

[57] ABSTRACT

A railway-track element is disclosed not only for normal track but also for rail points. The track element is formed of vacuum-treated steel containing at least 0.53 to 0.62% C, 0.65 to 1.1% Mn, 0.8 to 1.3% Cr, 0.05 to 0.11% Mo, 0.05 to 0.11% V and ≦0.02% P, the balance being iron plus the usual production-related impurities. The track element is in the form of a rail made of rolled pearlitic steel. If the track element is to be used for points, the starting material is a length of rolled rail with a martensitic structure produced by heat treatment at least in the rail head area.

17 Claims, 3 Drawing Sheets

RAILWAY-TRACK ELEMENTS AND METHOD OF MANUFACTURING THEM

The invention relates to railway-track elements manufactured using steel.

It is the increasing speed of trains in particular that results in ever higher demands being placed on the superstructure. Rails and points in particular are to have a high resistance to wear, crushing and fatigue damage. In addition, safety against fracture and suitability for welding should be ensured. These requirements are the reason for the use of rails with minimum tensile strengths of 900 N/mm$^2$ and 1100 N/mm$^2$.

The chemical composition and mechanical properties of rails of this type that are in use, as obtained for example from "Werkstoffkunde Stahl", Band 2, D 27, p. 594/602, published by Verlag Stahleisen, Düsseldorf in 1985, "Stähle für den Eisenbahnoberbau" are set forth as examples in Table 1

The combination of fine-pearlitizing with simultaneous precipitation hardening permits hardnesses of 400 HV to 440 HV at yield points of 800 N/mm$^2$ to 900 N/mm$^2$. The steels used come however close to the limit of permissible fracture toughness. Generally speaking, a tensile strength of 1400 N/mm$^2$ is regarded as the upper limit.

To achieve a higher strength at critically stressed areas in points, it has also been proposed to weld particularly hard special steel (HV ≧500) into the area of the frog point ("Developments in high-speed turnout design", Dr. Helmut Adelsberger, Voest-Alpine GmbH (1991)).

A substantially pearlitic steel alloy is described in DE 31 11 420 A1, in which the austenitizing temperature is above 743° in order to rule out unwelcome martensite formation during rolling/slipping processes between a wheel and a rail. To heat-treat points elements of steel, EP 0 247 021 A2 proposes that the steel be heated to austenitizing temperature, and then subjected to accelerated cooling by using a gaseous and/or liquid coolant, with at least two tuyere stocks

| Grade | C % | Mn % | Si % | Cr % | P max % | S max % | Rm N/mm$^2$ | A5 % |
|---|---|---|---|---|---|---|---|---|
| 700 | 0,40/0,60 | 0,80/1,25 | 0,05/0,35 | — | 0,05 | 0,05 | 680–830 | ≧14 |
| 900 A | 0,60/0,80 | 0,80/1,30 | 0,10/0,50 | — | 0,04 | 0,04 | 880–1030 | ≧10 |
| 900 B | 0,55/0,75 | 1,30/1,70 | 0,10/0,50 | — | 0,04 | 0,04 | 880–1030 | ≧10 |
| 1100* | 0,60/0,82 | 0,80/1,30 | 0,30/0,90 | 0,80/1,30 | 0,03 | 0,03 | ≧1080 | ≧9 |

*(The following can be added by alloying: Mo ≦ 0.1%, V ≦ 0.2%)

where:

C=carbon, Mn=manganese, Si=silicon, Cr=chromium, Pmax =phosphorus max, Smax=sulfur max, Rm=tensile strength, A5=breaking elongation.

The fact that with increasing tensile strength in self-hardening rails the fracture toughness generally decreases has led to developments both in rails and in points elements for further improvement of the useful properties by means of heat treatment. Martensitic heat treatment and fine pearlitizing (see for example "Zur Schienenherstellung und -entwicklung in Grossbritannien, in den U.S.A., in Kanada sowie in Japan", in "Stahl und Eisen 90" (1970), pages 922/28, or DE-PS 25 41 978 or DE 34 46 794 C1) have become prevalent here.

The drawback of martensitic heat treatment, i.e. austenitizing, quenching and tempering, is an insufficient hardening depth and/or tensile strengths below 1300 N/mm$^{32}$ at hardnesses less than 400 HV.

In points elements, in particular in the frog area, the material group of rail steels was replaced by heat treatable steels. Steels such as 50 Cr M4 and 50 Cr V 4 are used here.

However, the manufacture of heat treatable rails has been discontinued. One of the reasons was that the use of heat treatable steels in points does not permit the manufacture of points from a standardized material grade, since the heat treatable steels, when rolled to form rails, do not have the required mechanical and technological properties. They also show the limits of their heat treatment resistance.

In the case of fine-pearlitizing, UIC 900 A rails in accordance with Table 1 or a comparable AREA quality are assumed. Good hardening depths are obtained here, although the maximum values are limited to ≦400 HV. The yield point and the tensile strength are 850 N/mm$^2$ and 1250 N/mm$^2$ respectively (see for example "Erprobung hochfester naturharter Schienen auf der Gotthardtstrecke", Ch. Hoffmann, W. Heller, J. Flügge, R. Schweitzer, ETR 38 (1989), p. 775/781.

being used.

The object underlying the present invention is to provide railway-track elements or a method for their manufacture that can be used both for normal track and for points, with the steel used as track material being clearly superior in its fracture toughness and hence in its safety against fracture to pearlitic rails of corresponding strength stages. Also, the strength and the associated yield point should ensure a resistance to plastic deformation, which can occur in highly stressed points in particular.

The problem is solved in accordance with the invention in that the steel is a vacuum-treated steel with a guideline analysis of 0.53 to 0.62% C, 0.15 to 0.25% Si, 0.65 to 1.1% Mn, 0.8 to 1.3% Cr, 0.05 to 0.11% Mo, 0.05 to 0.11% V, ≦ 0.02% P, optionally up to 0.025% Al, optionally up to 0.5% Nb, residual iron, and the usual production-related impurities, with the ratio of Mn to Cr being about 0.80≦Mn:Cr≦0.85 and the ratio of Mo to V about 1, the railway-track element is in the form of a rolled-steel rail with pearlitic structure, and the railway-track element in the form of a points section is a rolled rail section as the starting material having at least in the rail head a martensitic structure from heat treatment.

With an Al-free steel, the Al content without controlled additions of Al should be between 0.001% and 0.005%, if possible less than 0.003%. If Al is used as an alloy constituent, 0.015 to 0.025% Al should be added. The hydrogen content should in any event be less than 2 ppm.

If necessary, the steel can contain niobium (Nb) in a proportion preferably between 0.002% and 0.04%.

According to the process, the problem is solved in accordance with the invention in that a vacuum-treated steel is used with a guideline analysis of 0.53 to 0.62% C, 0.15 to 0.25% Si, 0.65 to 1.1% Mn, 0.8 to 1.3% Cr, 0.05 to 0.11% Mo, 0.05 to 0.11% V, ≦0.02% P, optionally up to 0.025% Al, optionally up to 0.5% Nb, residual iron, and the usual production-related impurities, the steel is rolled to produce a rail as a railway-track element and has a pearlitic structure with a minimum strength of 900 N/mm$^2$, a section of the rolled rail is heated at least in the area of its head to an austenitizing temperature between about 850° C. and about 1050° in order to produce a points section as a railway-track element and is cooled using a cooling fluid within 60 to 120 seconds from a temperature of about 850° C. to about 500° C., and within 140 to 400 seconds from a temperature of about 500° C. to about 200° C., and then tempered to a minimum strength of 1500 N/mm$^2$. Further cooling down to room temperature can take place in the open air, for example.

If an Al-free steel is used, the Al content without controlled addition of Al should be between 0.001% and 0.005%, if possible less than 0.003%. If Al is used as an alloy constituent, 0.015 to 0.025% Al should be added.

The rail section is preferably inductively heated, and then cooled with compressed air at a cooling rate of about 175° C./minute from about 850° C. to about 500°C., then at a cooling rate of about 75° C./minute from about 500° C. to about 200° C., and then in still air down to room temperature, and then subjected at about 500° C. to a tempering operation preferably taking about 30 to 120 minutes.

With the teachings in accordance with the invention, it is possible with the material and the heat treatment to obtain, in a steel that is pearlitic in the rolled state, that is of like kind to standard and special grades and can be butt-welded, from initial strengths of ≧900 N/mm$^2$ or 1000 N/mm$^2$ or ≧1100 N/mm$^2$, strengths of more than 1500 N/mm$^2$ corresponding to a hardness of ≧450 HV by hardening and tempering in the rail head. Here the steel is clearly superior in its rolled state to pearlitic rails of the corresponding strength stages in its fracture toughness and hence in its safety against fracture. superior in its rolled state to pearlitic rails of the corresponding strength stages in its fracture toughness and hence in its safety against fracture. The strength and the associated yield point make it resistant to plastic deformations, such as occur in highly stressed points in particular.

The intended strength stages can be achieved in accordance with the invention with steels whose guideline analyses are shown in Table 2:

| Steel | Strength N/mm$^2$ | C % ± 0,02 | Si % ± 0,05 | Mn % ± 0,10 | Cr % ± 0,10 | Mo/V % ± 0,01 | P max % |
|---|---|---|---|---|---|---|---|
| 1 | ≧900 | 0,55 | 0,20 | 0,75 | 0,90 | 0,06 | 0.020 |
| 2 | ≧1000 | 0,58 | 0,20 | 0,85 | 1,00 | 0,08 | 0,020 |
| 3 | ≧1100 | 0,60 | 0,20 | 1,00 | 1,20 | 0,10 | 0.015 |

By the teachings in accordance with the invention, considerably better toughness and above all fracture toughness values are obtained in the rolled states in rails with, for example, the profile UIC 60 of the same strength than with rails according to the technical delivery terms UIC 860, as is shown in Table 3. The fracture toughness in particular is suitable for assessing the fracture behavior and is a measure for the safety against fracture.

| | Grade UIC 900 A | Steel 1 | UIC Steel 2 | Grade 1100 | Steel 3 |
|---|---|---|---|---|---|
| Tensile strength Rm(N/mm$^2$) | 975 | 975 | 1044 | 1126 | 1126 |

-continued

| | Grade UIC 900 A | Steel 1 | UIC Steel 2 | Grade 1100 | Steel 3 |
|---|---|---|---|---|---|
| Breaking elongation A5 (%) | 13,5 | 16,0 (+ 19%) | 15,0 | 10,0 | 13,0 (+ 30%) |
| Fracture toughness $K_{IC}$ (N/mm$^{3/2}$) | 1200 | 1750 (+ 46%) | 1670 | 1010 | 1650 (+ 63%) |

However, the railway-track elements heat-treated in accordance with the invention also have considerable advantages as regards their mechanical properties over fine-pearlitized rails, as the following table 4 proves:

| Treatment | $Rp_{0.2}$ N/mm$^2$ | Rm N/mm$^2$ | Reversed bending fatigue strength N/mm$^2$ | $K_{IC}$ N/mm$^{3/2}$ |
|---|---|---|---|---|
| fine-pearlitized according to invention | 850 | 1250 | 400 | 1050 |
| | 1390 | 1550 | 700 | 1800 |
| | +59% | +24% | +75% | +71% |

As the table makes clear, the yield point $Rp_{02}$ important for retaining the geometry in points rose 59%, and the tensile strength Rm by 24% compared with fine-pearlitized points. The reversed bending fatigue strength, which determines the resistance to fatigue damage such as guiding surface breakout, improved by 75%. At the same time, the fracture toughness $K_{IC}$ could be increased by about 70%.

The teachings in accordance with the invention provide considerable advantages for the construction of both rails and points. The longer life that can be expected ensures improved safety against fracture, greater passenger comfort and greater economy.

Further details, advantages and features of the invention are evident not only from the claims and from the features they describe, singly and/or in combination, but also from the following description of the drawings.

In the drawings,

FIG. 1 shows a cross-section through a railway-track element (10) manufactured in accordance with the invention in the form of a rail comprising a rail foot (12), a web (16) and a rail head (16).

Figure 1:
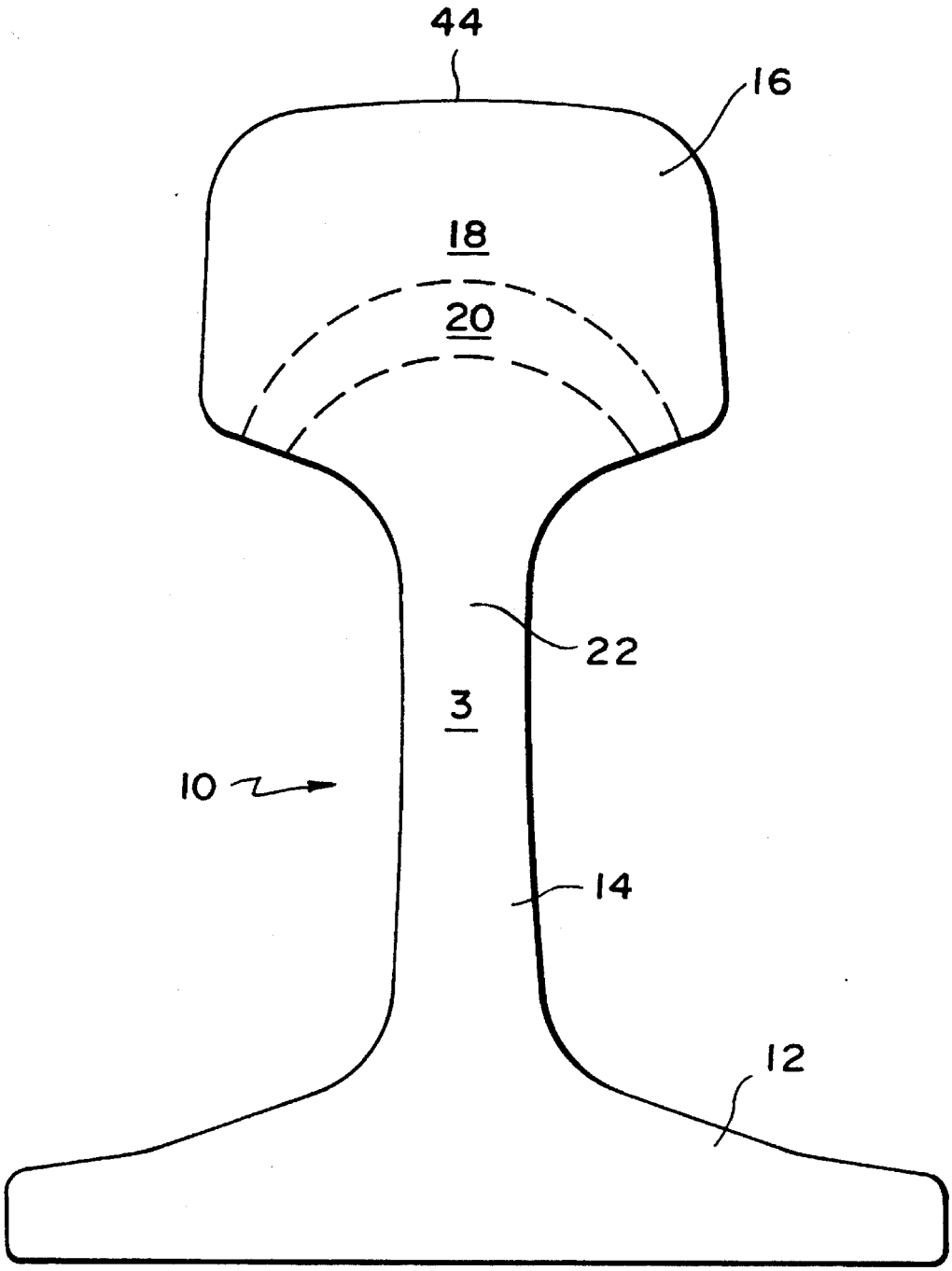
FIG. 1 shows a cross-section through a rail heat-treated in accordance with the invention

To manufacture the rail, a vacuum-treated steel with an analysis as shown in Table 2was used. In the case of an Al-free steel, the Al content is preferably between 0.001% and 0.005%, if possible less than 0.003%. However, aluminum can also be present with a proportion between 0.01% and 0.05%, and niobium with a proportion between 0.02% and 0.04%.

The rail is formed by rolling and has after rolling a pearlitic structure with a strength of 900 $N/mm^2$ to 1200 $N/mm^2$, with fracture toughnesses of more than 1500 $N/mm^2$.

In order to manufacture a points element from the railway-track element (10), it undergoes heat treatment, i.e. martensitic hardening and tempering. To do so, the rail head (16) is heated preferably inductively to the hardening temperature, i.e. to austenitizing temperature in the range from 850° C. to 1050. It is then cooled, with the temperature range between 850° C. and 500° C. being covered in 60 to 120 seconds and that between 500° C. and 200° C. in 140 to 400 seconds. The higher cooling rate should be applied in the lower alloy area and the lower cooling rate in the upper.

With this cooling process, martensite with low bainite proportions is obtained in the area of the outer rail head area (18) with the chemical compositions as stated. In the lower area (20), bainite proportions up to 70% are obtained between 500° C. and 250° C. These prevent the buildup of high cooling and transformation stresses in the transition to the basic material, and permit the use of relatively high C proportions without the formation of stress cracks.

In other words, the area numbered (18) (outer head area) is the heat treated area, that numbered (20) (inner head area) the transition area, and the area beneath that and numbered (22) the area corresponding to the rolled state. This area (22) extends from the lower part of the rail head (16) over the web (16) to the rail foot (12).

Once a temperature of 200° C. has been attained, further cooling of any type can follow if required. Tempering takes place in the temperature range between 450° C. and 600° C. depending on the tempering duration selected.

Figure 2:
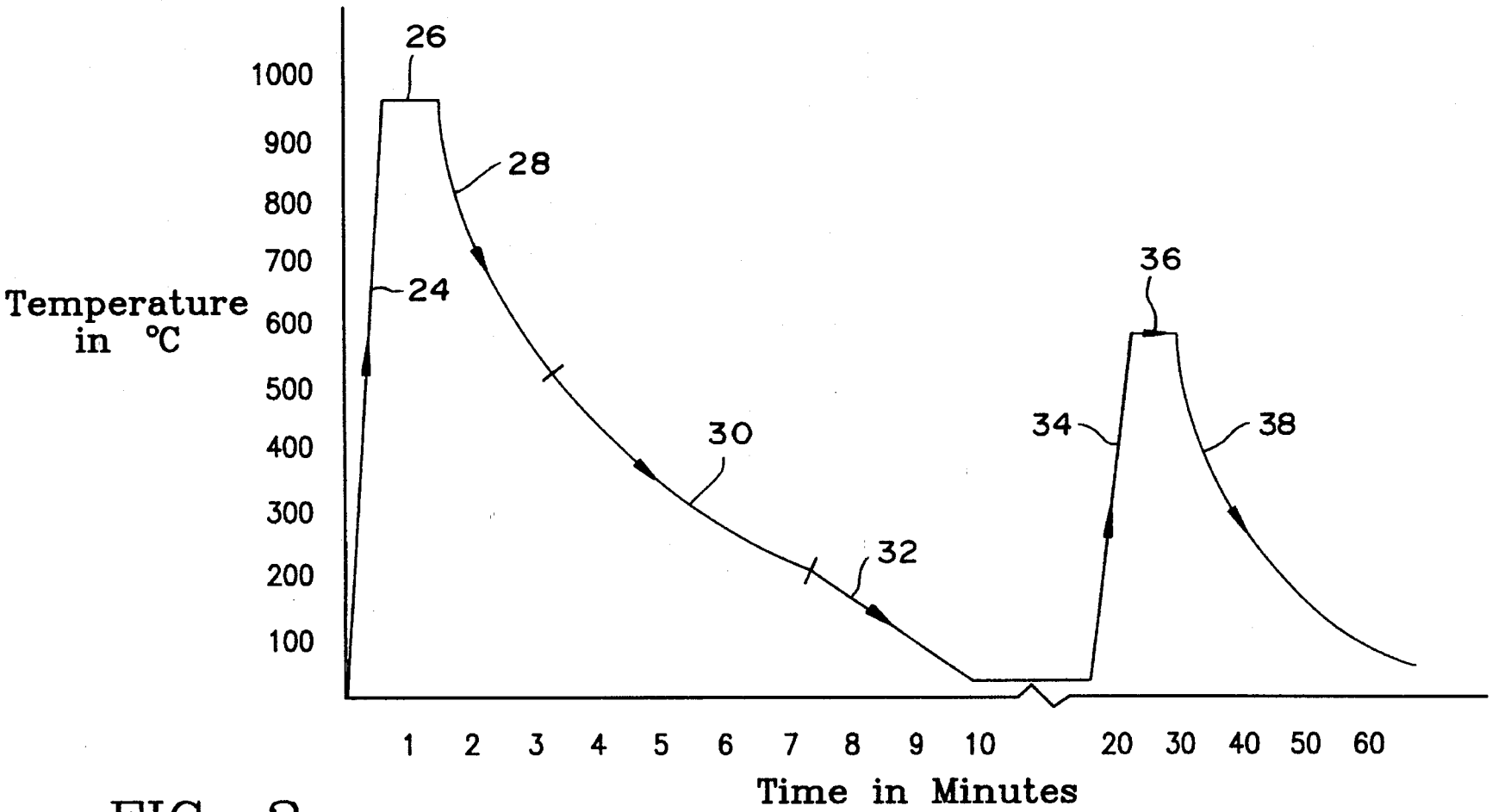
FIG. 2 shows a temperature/time graph of a heat treatment process (semi-diagrammatic)

FIG. 2 is a semi-diagrammatic view of the temperature/time curve in the intended heat treatment operation. The area (24) corresponds to heating up, the area (26) to temperature equalization, the area (28) to the cooling range between 950° C. and 500° C., the area (30) to the cooling range between 500° C. and 200° C., and the area (32) to the cooling range between 200° C. and 20° C. With the area (34), tempering starts, i.e. heating up to the tempering temperature. The area (36) is the holding time at the tempering temperature. Finally, the area (38) reflects cooling to room temperature. With inductive heating to 950° C. and the use of compressed-air cooling at a rate of 150° C./minute in the temperature range between 850° C. and 500° C. and 75° C./minute between 500° C. and 200° C., with subsequent cooling in still air to room temperature and a tempering treatment of 30 minutes at 500° C., a hardness curve as shown by the dashed line (40) in the dispersion range (42) in FIG. 3 was obtained for steel 3 in accordance with Table 3. The distance from the contacted area (44) of the rail head (16) along the vertical axis (46) is plotted in relation to the hardness HV in the graph.

Figure 3A:
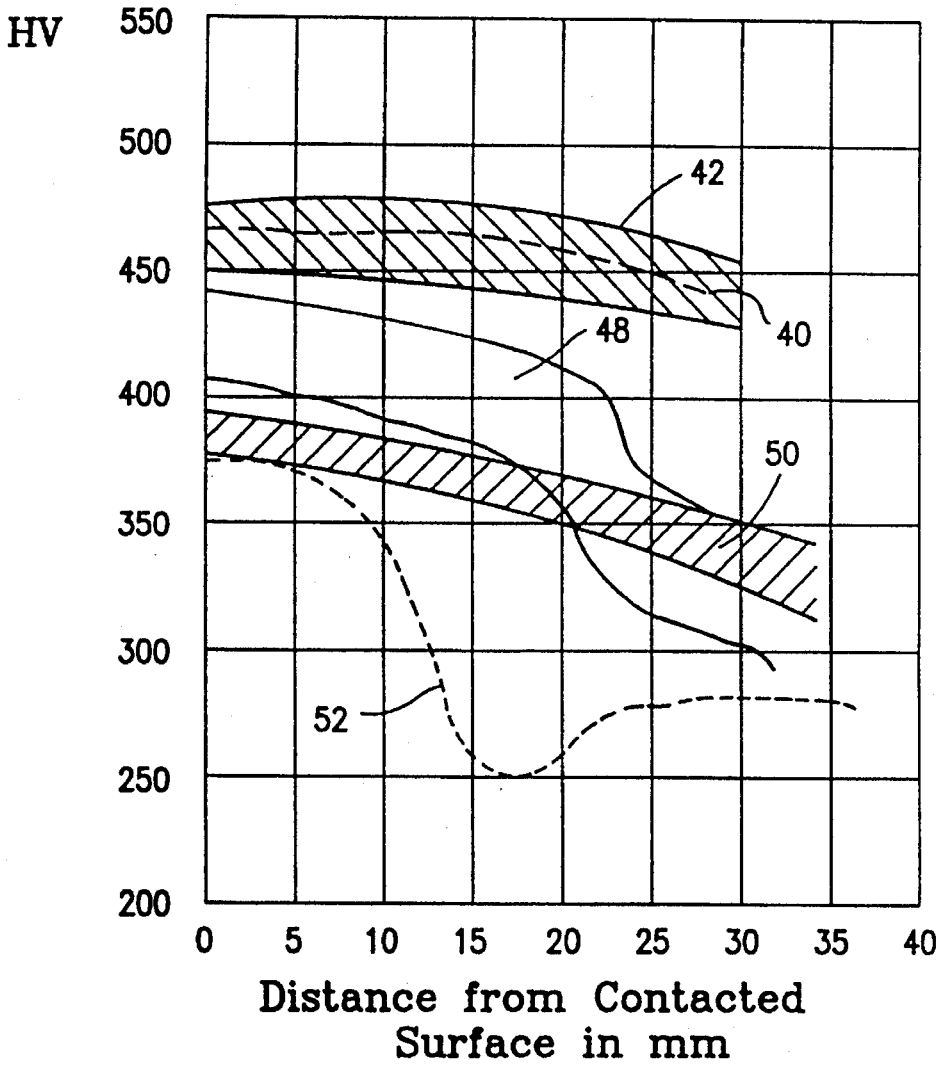
FIG. 3 shows the hardness curve of heat-treated rails.
Figure 3B:
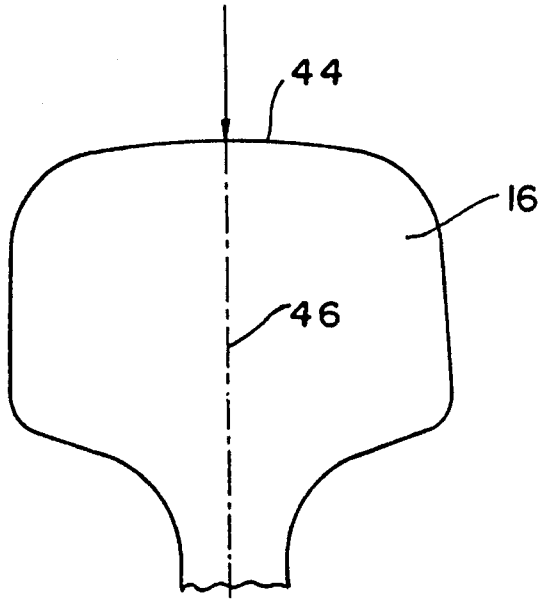

The other hardness curves shown in FIG. 3 correspond to points elements heat-treated according to the prior art.

The dispersion range (48) therefore corresponds to a fine-pearlitizing process according to DE 34 46 794 C1.

The dispersion range (50) is intended to represent fine-pearlitizing according to "Kopfgeh ärtete Schiene für hö; chste Betriebsansprüche", by H. Schmedders, H. Bienzeisler, K.-H. Tucke and K. Wick, in "ETR" (1990), issue 4.

In addition, the line (52) in FIG. 3 corresponding to an inductive heat treatment according to "Zur Schienenherstellung und -entwicklung in Grossbritannien, in den U.S.A., in Kanada sowie in Japan", in "Stahl und Eisen 90 " (1970), pages 922/28, makes clear the dip in hardness that is a drawback of martensitic structures and that frequently occurs in inadmissible depths.

Advantageous variants of the teachings in accordance with the invention are shown in the following:

The entire cross-section of the railway-track element (10) can be austenitized and cooled such that the area (18) in FIG. 1 forms martensite, the area (20) mainly bainite and the remaining cross-section pearlitic structure. Tempering takes place as already described. One advantage of this variant is that in the transition from the heat-treated area to the basic material no loss of cohesion occurs.

It is also possible to harden the entire cross-section and to temper it as already described.

Finally, the entire cross-section can be hardened and the areas (18) and (20) tempered as described. The remaining cross-section is additionally tempered at a temperature which is 100° to 150° C. higher, such that in this area the strength is about 400 $N/mm^2$ lower than in the areas (18) and (20). The advantage of this variant is additionally that in the web (14) and the foot (12) of the rail section (10) a particularly high safety against fracture is obtained.

It must be mentioned that the % quantities given for required proportions are of course percentages by weight.

We claim:

1. A railway-track element manufactured from steel, wherein said steel is a vacuum-treated steel with a guideline analysis of 0.53 to 0.62% C, 0.15 to 0.25% Si, 0.65 to 1.1% Mn, 0.8 to 1.3% Cr, 0.05 to 0.11% Mo, 0.05 to 0.11% V, ≦0.02% P, optionally up to 0.025% Al, optionally up to 0.5% Nb, residual iron, and the usual production-related impurities, with the ratio of Mn to Cr being about 0.80≦Mn:Cr≦0.85 and the ratio of Mo to V about 1, said railway-track element is in the form of a rolled-steel rail (10) with pearlitic structure, and said railway-track element in the form of a points section is a rolled rail section as the starting material having at least in the rail head area (18) a martensitic structure from heat treatment.

2. A railway-track element according to claim 1, wherein the Al content is between 0.001% and 0.005%.

3. A railway-track element according to claim 1, wherein the proportion of Al is between 0.015% and 0.025%.

4. A railway-track element according to claim 1, wherein the proportion of Nb is between 0.001% and 0.04%.

5. A railway-track element according to claim 1, wherein the rail comprising the rolled steel with pearlitic structure has a strength of 900 $N/mm^2$ to 1200 $N/mm^2$, with a fracture toughness of at least about 1500 $N/mm^{3/2}$.

6. A method for manufacturing a railway-track element comprising the steps of: rolling a vacuum-treated steel having a guideline analysis by weight of 0.53 to 0.62% C, 0.15 to 0.25% Si, 0.65 to 1.1% Mn, 0.8 to 1.3% Cr, 0.05 to 0.11% Mo, 0.05 to 0.11% V, ≦0.02% P, optionally up to 0.025% Al, optionally up to 0.5% Nb, residual iron, and the usual production-related impurities, with the ratio of Mn to Cr being about 0.80≦Mn:Cr≦0.85 and the ratio of Mo to V about 1 to produce a rail in the form of a railway-track element having at least a head portion and having a pearlitic structure with a minimum strength of 900 N/mm$^2$; heating a section of said rail at least in the area of its head portion to an austenitizing temperature between about 850° C. and 1050° C. in order to produce a railway-track element points section; cooling the heated railway-track element points section within 60 to 120 seconds from a temperature of about 850° C. to 500° C., within about 140 to 400 seconds from a temperature of about 500° C. to 200° C.; and then tempering to a minimum strength of 1500 N/mm$^2$.

7. A method according to claim 6,
wherein said section of said rail is inductively heated and then cooled optionally with compressed air at a cooling rate of about 175° C./minute from about 850° C. to about 500° C., then at a cooling rate of about 75° C./minute from about 500° C. to about 200° C., and then if necessary in still air down to room temperature, and then subjected at about 500° C. to a tempering operation.

8. A method according to claim 6,
wherein said tempering operation takes about 30 to 120 minutes.

9. A method according to claim 6,
wherein the entire cross-section of said section of said rail is austenitized and cooled such that in the outer head area (18) martensite is formed, in the adjacent inner head area (20) mainly bainite, and in the remaining area a pearlitic structure.

10. A method according to claim 6,
wherein said section of said rail is hardened over its entire cross-section.

11. A method according to claim 6,
wherein said section of said rail is hardened over its entire cross-section and then tempered in its outer and inner head areas (18, 20) at a tempering temperature $T_A$ with 500° C.<$T_A$<600° C., and then the remaining cross-section (12, 14, 22) is tempered at a temperature $T_B$ with $T_B$°$T_A$, preferably with $T_B$ about 100° C. to 150° C. higher than $T_A$ such that a strength is obtained that is about 400 N/mm$^2$ lower than in said outer and inner head areas.

12. A method for manufacturing points elements having strengths ≧1500 N/mm$^2$ in the rail head, comprising the steps of: rolling a vacuum-treated steel with a guideline analysis by weight of 0.53 to 0.62% C, 0.15 to 0.24% Si, 0.65 to 1.1% Mn, 0.8 to 1.3% Cr with the ratio Mn to Cr about 0.80≦Mn Cr≦0.85, 0.05 to 0.11% Mo, 0.05 to 0.11% V, with Mo: V ≈1, ≦0.02% P, optionally up to 0.025% al, optionally up to 0.5% Nb, residual iron, and the usual production-related impurities to produce a rail section having at least a head portion with a pearlitic structure and strengths from 900 N/mm$^2$ to 1200 N/mm$^2$ with fracture toughnesses of more than 1550 N/mm$^{3/2}$, heating at least the rail head portion to an austenitizing temperature of about 850° C. to 1040° C., cooling at least the rail head portion using a cooling fluid within 60 to 120 seconds from about 850° C. to about 500° C., and within 140 to 400 seconds from about 500° C. to about 200° C., and then tempering to strengths of more than about 1500 N/mm$^2$.

13. A railway-track element according to claim 1, wherein the Al content is less than 0.003%.

14. A railway-track element manufactured from steel with a guideline analysis by weight of 0.53 to 0.62% C, 0.15 to 0.25% Si, 0.65 to 1.1% Mn, 0.8 to 1.3% Cr, 0.05 to 0.11% Mo, 0.05 to 0.11% V, ≦0.02% P, optionally 0.001% to 0.005% Al, optionally up to 0.5% Nb, residual iron, and the usual production-related impurities, with the ratio of Mn to Cr being about 0.80≦Mn: Cr ≦0.85 and the ratio of Mo to V about 1, said railway-track element is in the form of a rolled-steel rail (10) with pearlitic structure, and said railway-track element in the form of a points section is a rolled rail section as the starting material having at least in the rail head area (18) a martensitic structure from heat treatment.

15. A railway-track element manufactured from steel with a guideline analysis by weight of 0.53 to 0.62% C, 0.15 to 0.25% Si, 0.65 to 1.1% Mn, 0.8 to 1.3% Cr, 0.05 to 0.11% Mo, 0.05 to 0.11% V, ≦0.02% P, optionally 0.015% to 0.025% Al, optionally up to 0.5% Nb, residual iron, and the usual production-related impurities, with the ratio of Mn to Cr being about 0.80≦Mn:Cr≦0.85 and the ratio of Mo to V about 1 , said railway-track element is in the form of a rolled-steel rail (10) with pearlitic structure, and said railway-track element in the form of a points section is a rolled rail section as the starting material having at least in the rail head area (18) a martensitic structure from heat treatment.

16. A railway-track element manufactured from steel with a guideline analysis by weight of 0.53 to 0.62% C, 0.15 to 0.25% Si, 0.65 to 1.1% Mn, 0.8 to 1.3% Cr, 0.05 to 0.11% Mo, 0.05 to 0.11% V, ≦0.02% P, optionally up to 0.025% Al, optionally 0.001% to 0.04% Nb, residual iron, and the usual production-related impurities, with the ratio of Mn to Cr being about 0.80≦Mn:Cr≦0.85 and the ratio of Mo to V about 1, said railway-track element is in the form of a rolled-steel rail (10) with pearlitic structure, and said railway-track element in the form of a points section is a rolled rail section as the starting material having at least in the rail head area (18) a martensitic structure from heat treatment.

17. A railway-track element according to claim 1 wherein the vacuum-treated steel has a hydrogen content of <2 ppm.

* * * * *